US009831560B2

(12) United States Patent
Driscoll et al.

(10) Patent No.: US 9,831,560 B2
(45) Date of Patent: Nov. 28, 2017

(54) APPARATUS FOR REDUCING SCATTERING AND METHODS OF USING AND MAKING SAME

(71) Applicant: Elwha LLC, Bellevue, WA (US)

(72) Inventors: Tom Driscoll, San Diego, CA (US); David R. Smith, Durham, NC (US); Yaroslav A. Urzhumov, Bellevue, WA (US)

(73) Assignee: Elwha LLC, Bellevue, WA (US)

( * ) Notice: Subject to any disclaimer, the term of this patent is extended or adjusted under 35 U.S.C. 154(b) by 495 days.

(21) Appl. No.: 14/448,711

(22) Filed: Jul. 31, 2014

(65) Prior Publication Data

US 2016/0036133 A1 Feb. 4, 2016

(51) Int. Cl.
*H01Q 15/14* (2006.01)
*H01Q 1/52* (2006.01)

(52) U.S. Cl.
CPC ..... *H01Q 15/14* (2013.01); *H01Q 1/528* (2013.01)

(58) Field of Classification Search
CPC ..... H01Q 15/14; H01Q 1/528
USPC ..... 342/1–12
See application file for complete search history.

(56) References Cited

U.S. PATENT DOCUMENTS 5,910,787 A * 6/1999 Berg ..... H01Q 15/00 342/165
2008/0024792 A1* 1/2008 Pendry ..... F41H 3/00 356/602
2008/0165442 A1* 7/2008 Cai ..... B82Y 20/00 359/896
2010/0053763 A1* 3/2010 Chowdhury ..... B82Y 20/00 359/652
2011/0102098 A1* 5/2011 Venermo ..... H01Q 17/00 333/33
2014/0238734 A1* 8/2014 Boulais ..... H05K 9/00 174/350

OTHER PUBLICATIONS

C. A. Valagiannopoulos, P. Alitalo and S. Tretyakov, "Dielectric-coated PEC cylinders which do not scatter electromagnetic waves," 2012 International Conference on Electromagnetics in Advanced Applications, Cape Town, 2012, pp. 90-91.*
Accoustic Properties for Metals in Solid Form, from NDT Resource Center (https://www.nde-ed.org/GeneralResources/MaterialProperties/UT/ut_matlprop_metals.htm), retrieved on Aug. 20, 2014, 4 pages.
Fokin et al., "Method for retrieving effective properties of locally resonant acoustic metamaterials", The American Physical Society, 2007, 5 pages.
Landy, Nathan and Smith, David R., "A full-parameter unidirectional metamaterial cloak for microwaves", Nature Materials, vol. 12, Jan. 2013, pp. 25-28.

(Continued)

*Primary Examiner* — Marcus E Windrich
(74) *Attorney, Agent, or Firm* — Foley & Lardner LLP

(57) ABSTRACT

An apparatus for reducing electromagnetic scattering includes a first component having a plurality of curved segments, each including a first reflective material, and together forming an enclosed cavity; and a second component having a plurality of flat or cylindrically-curved segments, each comprising a second reflective material. The second component is positioned external to the cavity.

10 Claims, 5 Drawing Sheets

(56) References Cited

OTHER PUBLICATIONS

Li et al., "Transmission Characteristics in Tubular Acoustic Metamaterials Studied with Fluid Impedance Theory", Chinese Physics Letters, vol. 28, No. 10, May 13, 2011, 4 pages.
Urzhumov et al., "Isotropic-medium three-dimensional cloaks for acoustic and electromagnetic waves", Journal of Applied Physics 111, 2012, 8 pages.
Urzhumov et al., "Low-loss directional cloaks without superluminal velocity or magnetic response", Optical Society of America, Nov. 1, 2012, vol. 37, No. 21, pp. 4471-4473.

* cited by examiner

APPARATUS FOR REDUCING SCATTERING AND METHODS OF USING AND MAKING SAME

BACKGROUND

Modern communication and object detection systems, including radar and other systems, often operate in environments crowded with other necessary structural elements, such as buildings, pillars, masts (in a context of a naval vessel) or other structural elements. These structural elements often need to be placed in close proximity of the operating systems, thus reducing the field of view of the systems, and potentially adding unwanted reflections or other undesirable effects.

SUMMARY

One embodiment relates to an apparatus for reducing electromagnetic scattering, including a first component having a plurality of curved segments, each including a first reflective material, and together forming an enclosed cavity; and a second component having a plurality of flat or cylindrically-curved segments, each including a second reflective material, wherein the second component is positioned external to the enclosed cavity.

Another embodiment relates to an apparatus for reducing scattering, including a first component having a plurality of curved segments, each curved segment including a first reflective material and being rotationally invariant about an axis of revolution, wherein the plurality of curved segments form an enclosed cavity about the axis of revolution; and a second component having a second reflective material and being positioned external to the enclosed cavity, wherein the second component has a longitudinal axis parallel to the axis of revolution.

Another embodiment relates to a method of transmitting electromagnetic waves, including exposing incident electromagnetic waves having a first impact parameter to an apparatus, wherein the apparatus allows at least one electromagnetic wave having a second impact parameter to exit the apparatus, wherein the apparatus includes a first component having a plurality of curved segments, each including a first reflective material, and together forming an enclosed cavity; and a second component having a plurality of discrete non-curved segments, each including a second reflective material, wherein the second component is positioned external to the enclosed cavity.

Another embodiment relates to a method of transmitting waves, including exposing incident waves having a first impact parameter to an apparatus, wherein the apparatus allows at least one wave having a second impact parameter to exit the apparatus, wherein the apparatus includes a first component having a plurality of curved segments, each curved segment including a first reflective material and being rotationally invariant about an axis of revolution, wherein the plurality of curved segments form an enclosed cavity about the axis of revolution; and a second component having a second reflective material and being positioned external to the enclosed cavity, wherein the second component has a longitudinal axis parallel to the axis of revolution.

Another embodiment relates to a method of making an apparatus configured to reduce electromagnetic scattering, the method including assembling a first component and a second component to form the apparatus; wherein the first component includes a plurality of curved segments, each having a first reflective material, and together forming an enclosed cavity; and wherein the second component includes a plurality of flat or cylindrically-curved segments, each having a second reflective material, wherein the second component is positioned external to the enclosed cavity.

Another embodiment relates to a method of making an apparatus configured to reduce scattering, the method including assembling a first component and a second component to form the apparatus; wherein the first component includes a plurality of curved segments, each curved segment having a first reflective material and being rotationally invariant about an axis of revolution; wherein the plurality of curved segments form an enclosed cavity about the axis of revolution; and wherein the second component includes a second reflective material and is positioned external to the enclosed cavity, the second component having a longitudinal axis coaxial with the axis of revolution.

Another embodiment relates to a method of reducing wave scattering, including receiving incident waves travelling in a first direction at a first curved member and reflecting the waves to focus the waves on a focal point on a non-curved member; reflecting the focused waves from the non-curved member to a second curved member; and reflecting the focused waves from the second curved member to form exiting waves travelling in the first direction.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1A:
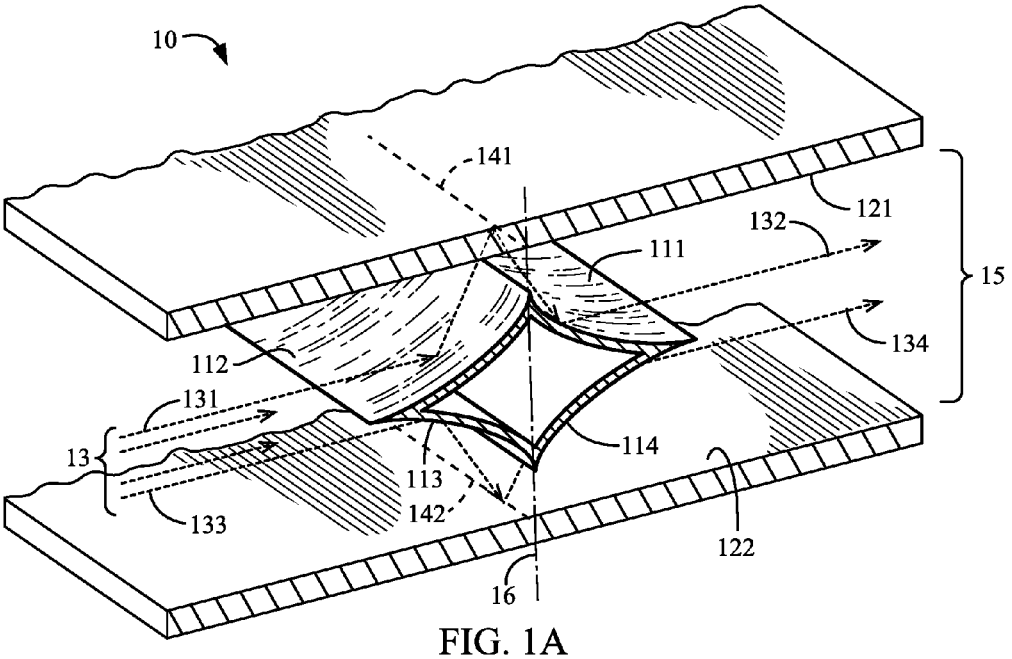
FIGS. 1A-1B are schematic illustrations of an apparatus for reducing scattering according to one embodiment.

In the following detailed description, reference is made to the accompanying drawings, which form a part thereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Techniques for reduction of the scattering cross-section of various objects have been demonstrated in recent years, following the theoretical framework of metamaterial-based transformation optics "cloaks." However, many of these metamaterial-based systems tend to be complex, with a narrow-band response and limited scalability towards larger objects and/or higher frequencies. Their scalability is often limited mostly by the utilization of metallic components spread over a certain, often substantial, volume surrounding the object to be cloaked. The pre-existing systems may also introduce ohmic loss, and consequently attenuation, making these systems difficult to scale up in size or frequency.

Various embodiments disclosed herein relate to an apparatus or system configured to reduce signal or wave scattering and methods of using such an apparatus or system. In one embodiment, the system may be employed to reduce, or even eliminate, radar blockage caused by (geometrically and/or electrically) large objects. It should be appreciated that various embodiments introduced above and discussed in greater detail below may be implemented in any of numerous ways, as the disclosed embodiments are not limited to any particular manner of implementation. Examples of specific implementations and applications are provided primarily for illustrative purposes.

In some embodiments, the structures described herein may refer to apparatuses that are configured to transmit a propagating wave, which may take the form of or be approximated by a wave (e.g., a signal wave, etc.), one or more rays or beams, etc. The waves may include, for example, plane waves. The waves may further include, for example, electromagnetic radiation. An example of electromagnetic radiation is a radio frequency wave. Accordingly, the structures described herein may be a part of a radio frequency communication device. An example of a radio frequency communication system is a radar system. According to various alternative embodiments, the structures and methods disclosed herein are usable with other forms of ray/beam/wave propagation, including airborne or underwater sonar, acoustic wireless communications, ultrasound imaging, and the like.

Furthermore, various components disclosed herein may be referred to as "curved," or using other similar terms. It should be understood that as used herein "curved" may include approximations of curved surfaces (e.g., such that a curved surface may include an arrangement of flat surfaces that collectively approximate a curved surface, such as is the case of a facet approximation).

The apparatuses described herein may reduce scattering while transmitting signals, waves, and the like. In one embodiment, the apparatus is configured to reduce the scattering cross-section of a component contained in a structure. The apparatuses may be subjected to multiple propagating waves or signals, such as signals from different directions. For example, the apparatuses may be subjected to signals that may be wave-like signals from one certain direction, and/or to signals from a direction opposite to the aforementioned direction. When the spatial profile of the signal emitted by the apparatus (e.g., a radar system) is close enough to a plane wave, which occurs in the radiative near field and further away, the appropriate measure of interference caused by an object in the field of view of the apparatus is the (total) scattering cross-section ("TSCS"). In one embodiment, this physical quantity measures the amount of energy that is removed from the original signal beam by all possible scattering processes, including reflection (e.g., specular or diffuse), refraction, and diffraction (e.g., sideways scattering). The apparatuses provided herein may be configured to reduce the TSCS of an otherwise electrically and/or geometrically large (e.g., non-transparent) object. As described in further detail below, in one embodiment, the reduction of cross-section by the apparatuses described herein is at least a factor of 5—e.g., at least 6, 7, 8, 9, 10, 15, 20, 25, 50, or more (e.g., as calculated by computer simulation).

Figure 1B:
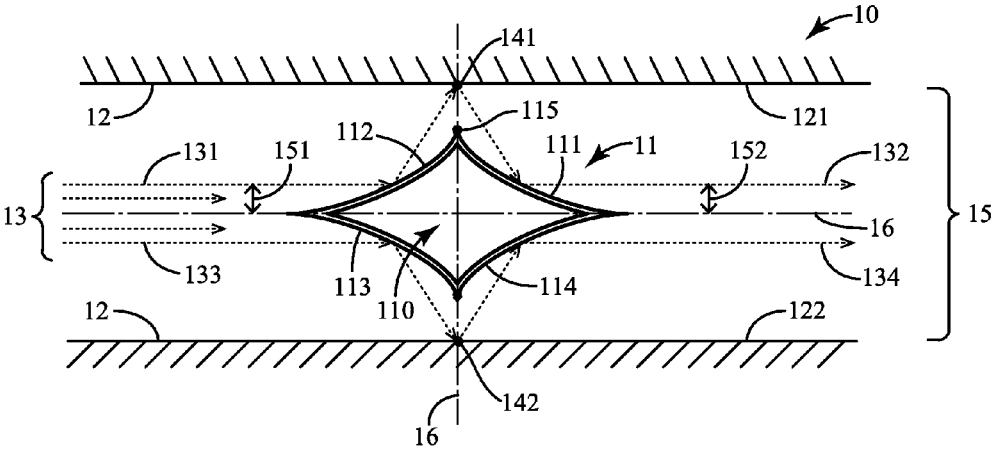

Referring to FIGS. 1A-1B, one embodiment herein provides apparatus 10 for reducing scattering. Apparatus 10 may include at least two components. First component 11 may include multiple curved segments. The curved segments may include a first reflective material and contiguously form enclosed cavity 110. Second component 12 may include multiple discrete non-curved segments. The non-curved segments may include a second reflective material. Second component 12 may be positioned external to enclosed cavity 110. Enclosed cavity 110 in this instance may be an electromagnetic cavity.

The first reflective material may be the same as, or different from, the second reflective material. Any suitable reflective material, such as a mirror material, may be used as the first and/or second reflective materials. For example, the first reflective material or the second reflective material may comprise a metal.

In one embodiment, the first component 11 includes four curved segments 111, 112, 113, and 114, each in a quadrant; but any suitable number of curved segments is possible. As shown in FIG. 1, curved segments 111, 112, 113, and 114 may be contiguous curved segments. These curved segments may define at least one plane of symmetry, although no particular symmetry is needed. In one embodiment, the multiple curved segments define two different planes of symmetry. The curved segments may have any suitable curvature. Each of the curved segments may resemble a parabola (e.g., such that a reflective surface of each curved segment defines a curved line that approximates a segment of a parabola). For instance, as shown in FIG. 1, each of the multiple curved segments has a parabolic-shaped surface, which is concave with respect to an exterior of enclosed cavity 110.

Second component 12 may include multiple discrete non-curved (e.g., flat or planar) segments. In one embodiment, second component 12 includes two discrete non-curved segments 121 and 122, but any suitable number of non-curved segments is possible. Non-curved segments 121 and 122 may be "non-curved" relative to the curved segments of the first component in the sense that the curved segments have a radius of curvature smaller than the radius of curvature of the non-curved segments. In some embodiments, the non-curved segments include a curvature to accommodate or compensate for various aberrations otherwise introduced by the apparatus. In one embodiment, two of curved segments 111 and 112 of first component 11 form apex 115; and segments 111 and 112 have a first radius of curvature, and second component 12 has a second radius of curvature in a vicinity of the apex; and the first radius of curvature is smaller than the second radius of curvature. In one embodiment, non-curved segments 121 and/or 122 are aligned with respect to transverse axis 16 with at least one apex 115 of the first component.

In one embodiment, various dimensions of second component 12 are minimized to in turn minimize any contribution to the scattering cross-section of the apparatus and maximize the cloaking efficiency of the apparatus. For example, in some embodiments, the thickness (e.g., as measured along transverse axis 16) and length (e.g., as measured in a direction perpendicular to transverse axis 16) are minimized. In one embodiment, the thickness of the reflective coating of the second component 12 (e.g., the thickness of segment 121 or the thickness of segment 122)

is configured to be between 1-3 penetration depths (e.g., electromagnetic skin depths) in addition to a nominal thickness of a supporting substrate (e.g., to provide structural support). For various materials and types of wave propagation, the penetration or skin depth may be as small as 20 nanometers (e.g., in the case of using gold or silver with optical wavelengths), or alternatively, a fraction of 1 micron (e.g., in the case of microwaves). According to various alternative embodiments, other thicknesses may be used for the various segments of second component 12.

Similarly, in one embodiment the length of second component 12 is minimized to further maintain a low scattering cross-section for the apparatus. For example, in one embodiment, the length of second component 12 (e.g., segments 121 and 122) is substantially less than the length of first component 11 (e.g., measured perpendicular to transverse axis 16). In further embodiments, the length of second component 12 is tuned to a particular wavelength and focal point width, such that the width of second component 12 is determined based on the focal point width. In some embodiments, the length of second component 12 is between 1 and 3 wavelengths of an incident propagating wave. In other embodiments, the length of second component 12 is enlarged to accommodate imperfectly collimated incident waves. According to various alternative embodiments, second component 12 may take other lengths.

The operational principle of the apparatuses described in one embodiment herein may be illustrated by considering electromagnetic radiation in the eikonal limit (geometrical optics approximation). The curved segments of first component 11 may be configured to direct rays incident upon the curved segments to specific focal point(s). The focal point is designed to be situated on the surface of the non-curved segment of second component 12. Second component 12 is configured to redirect the focused beam onto a second curved segment of first component 11. The second curved component reflects and/or expands the focused beam into an exiting wave or beam, which then exits apparatus 10. As used herein, a "focal point" includes a line (e.g., extending along a surface of a generally planar or non-curved surface), a circle (e.g., extending along an interior surface of a cylinder), or a point along a direction of travel of a plurality of waves.

Referring further to FIGS. 1A-1B, first component 11 is configured to focus a plurality of incident waves 13 (e.g., ray(s), beam(s), etc.) upon focal point 141 on a portion of second component 12. In this instance, first segment 112 of the multiple curved segments of first component 11 is configured to focus a portion of incident waves 131 upon focal point 141 on a surface of first non-curved segment 121 of second component 12. There may be a focal point on each of the discrete non-curved segments of second component 12. First non-curved segment 121 is configured to redirect focused waves from focal point 141 onto second segment 111 of first component 11. Second segment 111 is configured to reflect or expand the directed focused waves into waves 132 (e.g., a planar wave or beam) exiting apparatus 10.

The description provided above illustrates one half (e.g., the upper half) of first component 11 shown FIG. 1. The second half (e.g., the lower half) of first component 11 similarly may be configured to transmit waves. In this instance, third segment 113 of first component 11 is configured to focus another portion 133 of incident waves 13 upon focal point 142 on a surface of second non-curved segment 122 of second component 12. Second non-curved segment 122 is configured to redirect the focused waves from focal point 142 on the second non-curved segment onto fourth segment 114 of first component 11. Fourth segment 114 is configured to reflect or expand the directed focused waves into waves 134 (e.g., a planar wave or beam) exiting apparatus 10. In one instance, waves 132 and waves 134 may become or form an exiting beam or wave.

The apparatuses described herein may allow an impact parameter of each signal wave incident upon the curved reflective curved segment to be restored once the wave exits the apparatuses. Specifically, the apparatuses described herein may be configured to allow an incident wave having a first impact parameter to enter the apparatus and leave as an exiting wave having a second impact parameter, the second impact parameter being within about 10%, within about 5%, or within about 1% of the first impact parameter. For example referring to FIG. 1B, incident ray 131 has a first impact parameter 151, and exiting ray 132 has a second impact parameter 152. In one embodiment, the first impact parameter is equal to the second impact parameter.

In one embodiment, assuming all of the non-curved and curved segments described herein have 100% reflectance, the apparatuses described herein may provide a zero scattering cross-section within the accuracy and applicability of geometrical optics. In some embodiments, the scattering cross-section (e.g., the electromagnetic scattering cross-section) of the apparatus is less than the geometric cross-section of the apparatus. In further embodiments, the scattering cross-section of the apparatus is less than the geometric cross-section of the first component (e.g., the cavity), such as less than 90%, less than 75%, less than 50%, or less than 25% (in other embodiments the scattering cross-section of the apparatus may be less than the geometric cross-section of the first component or cavity by other amounts).

Defining the reduction of scattering cross section in yet further ways, in some embodiments, the scattering cross-section of the apparatus is in some embodiments less than (e.g., less than 90%, 75%, 50%, 25%, etc.) the scattering cross-section of the first component, if used by itself without the second component, or alternatively, the scattering cross-section of a reflecting cylinder having a radius equal to that of the second component (referring to the embodiment shown in FIGS. 2A-2B) used without the first component. In further embodiments, the scattering efficiency factor (e.g., scattering cross-section divided by geometric cross-section) is less than 0.9, less than 0.75, or less than 0.5, or another suitable number less than 1.

Figure 2A:
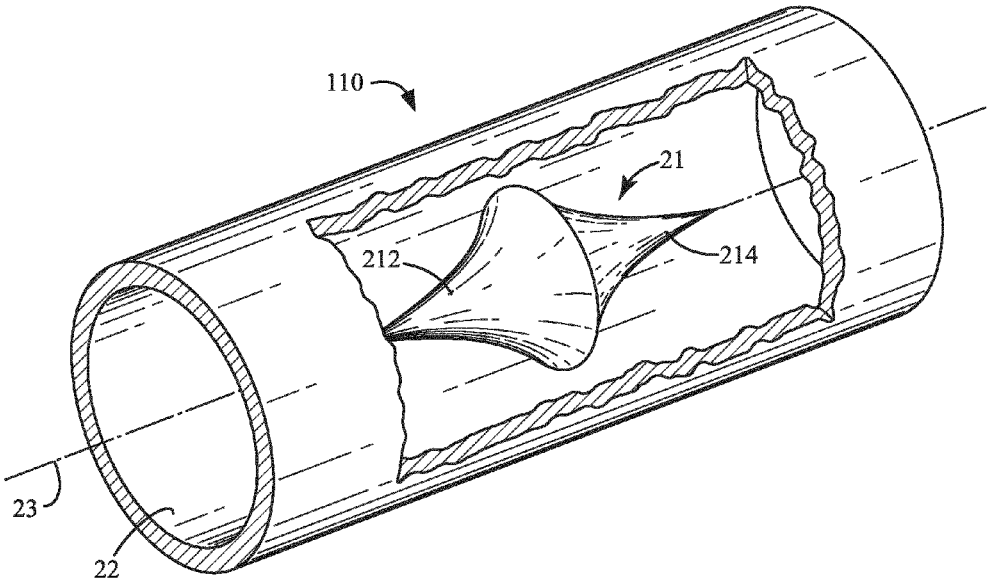
FIGS. 2A-2B are schematic illustrations of an apparatus for reducing scattering, according to another embodiment.
Figure 2B:
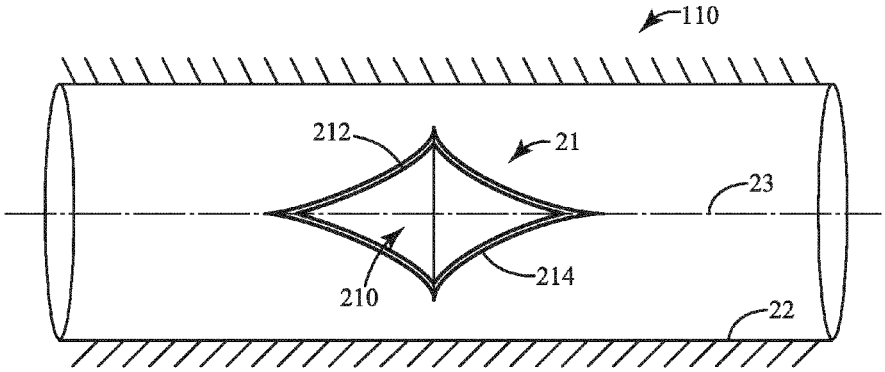

Referring now to FIGS. 2A-2B, apparatus 110 is shown according to one embodiment. Apparatus 110 includes first component 21 comprising multiple curved segments. The multiple curved segments 212 and 214 are similar to segments 111, 112, 113, and 114 in FIGS. 1A-1B, except in this instance each of 212 and 214 is defined by a surface of revolution of a segment of a parabola about the axis of revolution 23. Similar to apparatus 10 described in FIGS. 1A-1B, the parabolic curved segments may include a first reflective material and contiguously form an enclosed cavity/volume 210 about axis of revolution 23. The multiple curved segments of first component 21 are also rotationally invariant about the axis of revolution 23 in this instance. Second component 22 may comprise a second reflective material and be positioned external to enclosed cavity 210. In one embodiment, second component 22 defines a cylinder about and external to first component 21. As described above, second component 22 may have a longitudinal axis that is parallel to the axis of revolution 23. In one embodiment, the longitudinal axis of second component 22 is the same as the axis of revolution 23, thereby making first component 21 and second component 22 coaxial with respect to the axis of revolution 23.

Apparatus 110 as shown in FIGS. 2A-2B may be configured to transmit waves and/or signals and reduce scattering thereof similarly to apparatus 10 shown in FIGS. 1A-1B. For example, first component 21 is configured to focus a plurality of incident waves upon at least one focal point on at least one portion of second component 22. The focal point may be on at least one surface of at least one portion of second component 22. In this embodiment, a first segment or portion of the multiple curved segments of first component 21 is configured to focus a portion of a incident waves upon a focal point on a surface of a first portion of second component 22. The first portion of second component 22 is configured to redirect the focused waves from the focal point onto a second segment or portion of first component 21. Subsequently, the second curved segment or portion is configured to reflect and/or expand the directed focused waves into a wave or beam exiting apparatus 110.

Apparatus 110 as shown in FIGS. 2A-2B may have scattering-reduction properties (e.g., in terms of the impact parameters, scattering cross-section, scattering efficiency factor, etc.), as described with respect to apparatus 10 shown in FIGS. 1A-1B.

First component 21, including the multiple curved segments, may be rotationally invariant. Specifically, referring to FIG. 2A, the multiple curved segments of first component 21 may be rotationally invariant about axis of revolution 23. Second component 22 may also be rotationally invariant. For example, second component 22 may be rotationally invariant about the same axis of revolution 23, thereby making first component 21 and second component 22 coaxial with respect to the axis of revolution 23. Alternatively, the non-curved segments are not necessarily rotationally invariant but are parallel to the axis of revolution 23. For example, second component 22 may be rotationally invariant about a longitudinal axis that is not the same as the axis of revolution 23. This longitudinal axis may be parallel to the axis of revolution 23, although it need not be. In one instance, apparatus 110 as a whole may be rotationally invariant, such as about the axis of revolution 23.

As noted above, in some embodiments, the waves or signals propagating through the apparatus include electromagnetic radiation, such as radio frequency waves, microwaves, etc. As such, the first and second components may be made of a suitable material, such as metal, and be of the same or different materials. In alternative embodiments, the waves propagating through the apparatus may be acoustic waves (e.g., airborne or underwater sonar, acoustic wireless communications, ultrasound imaging, etc.), and may propagate through either air (or other gaseous medium) or water (or other liquid medium).

In one embodiment, the waves are acoustic waves and one or both of the first and second components are materials having relatively high or relatively low (characteristic) acoustic impendence (Z). Characteristic acoustic impendence is the product of the density and speed of sound in a medium (when no sound waves are travelling through it). In the context of airborne sound waves, Z is approximately 415 Rayls ($N*s/m^3$) at room temperature, whereas in the context of underwater waves, Z is much higher, being approximately 1.5 megaRayls (1.5 $MN*s/m^3$). As such, in one embodiment, the first and second components are solid materials (e.g., in the case of airborne waves), to provide a structure having a relatively much higher impedance than the medium of travel (air) for the waves. In an alternative embodiment, the first and second components are high density, high speed of sound materials (e.g., in the case of underwater waves), such as tungsten or metal, to provide a structure having a relatively higher impedance than the medium of travel (water). Alternatively, a low impendence material may be used for the first and/or second component in the case of underwater waves. For example, the first and/or second component may include a suitable gas-filled cavity (e.g., similar to a balloon, etc.).

In yet further embodiments, other materials may be used to direct acoustic waves through the apparatus. For example, in some embodiments, an acoustic metamaterial may be configured to provide either a high impedance or low impedance structure for the first and/or second component. In further embodiments, a phononic crystal or Bragg reflector may be used for the first and/or second components. In yet further embodiments, any combination of the materials disclosed herein may be utilized to properly direct waves through the apparatus.

Figure 3:
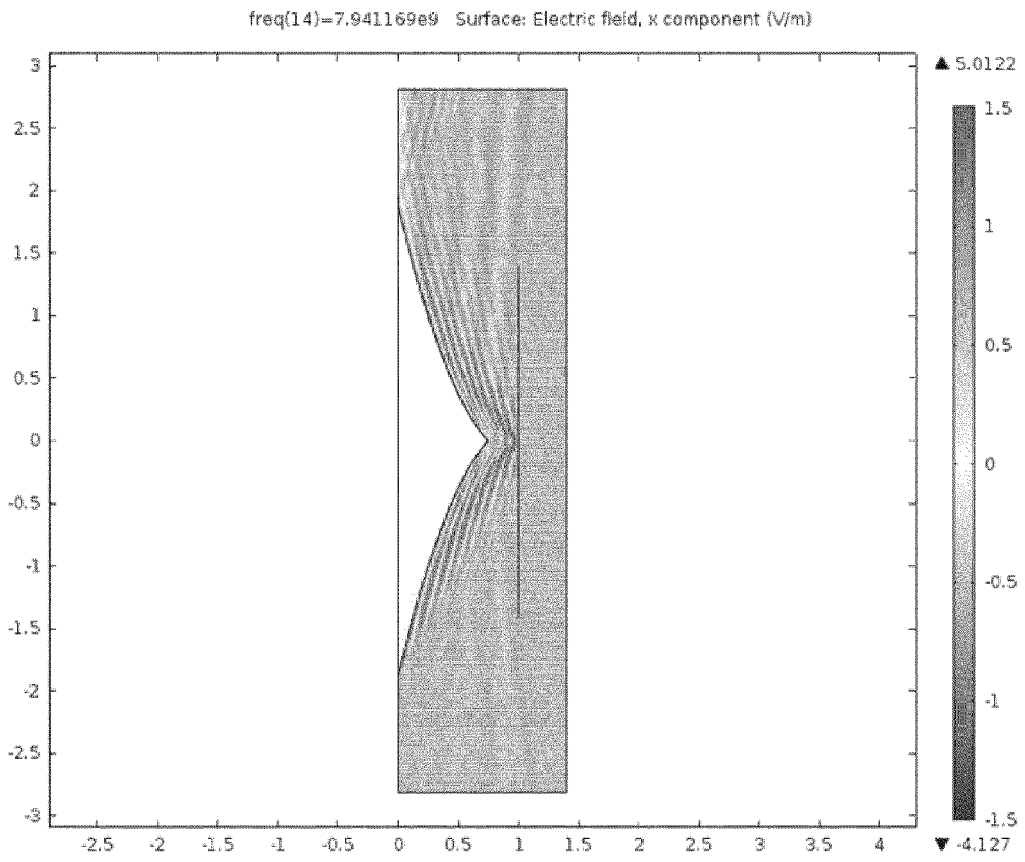
FIG. 3 shows results of a full-wave simulation of a plane wave propagating through an apparatus for reducing scattering according to one embodiment
Figure 4A:
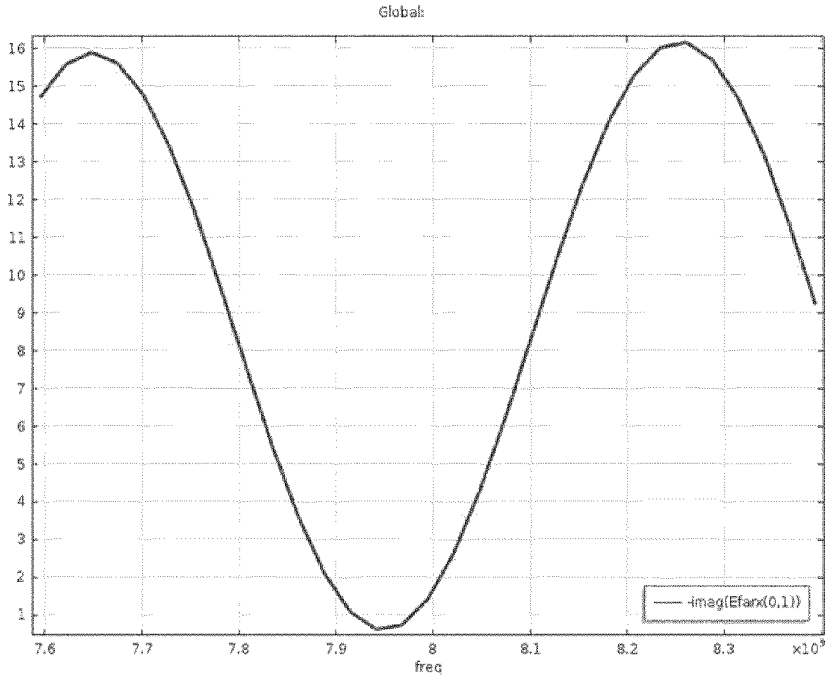
FIGS. 4A-4B show scattering cross-section as a function of frequency for the apparatus depicted in FIG. 3 according to one embodiment, including extinction cross-section from the optical theorem (extracted from the forward scattering amplitude); and norm of the scattered field on the closed surface surrounding the apparatus.
Figure 4B:
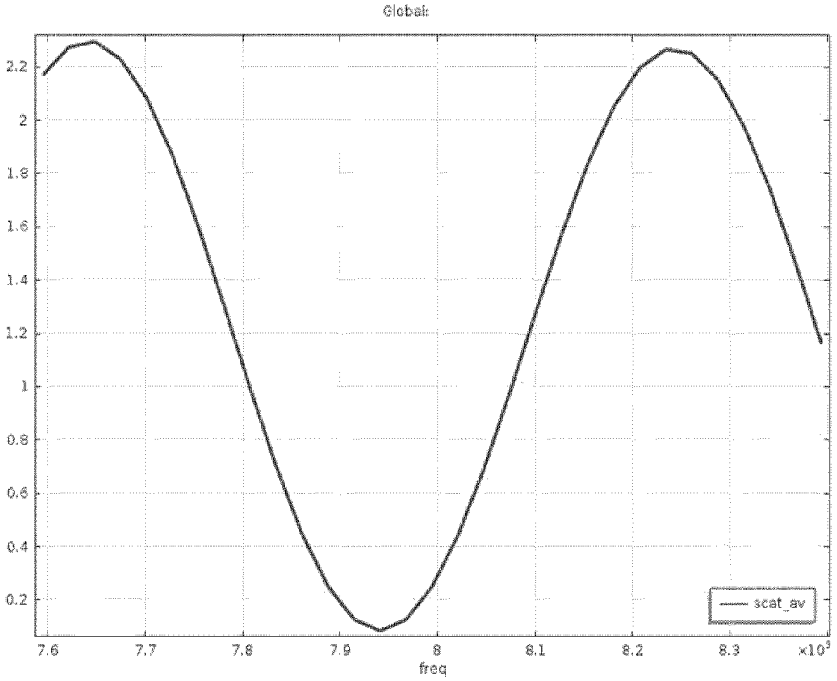

Referring to FIG. 3, the solution to the full-wave propagation problem is shown by computer modeling to demonstrate that the apparatuses described herein may have a reduced scattering cross-section. The computer modeling in this instance is by a standard RF propagation solver—only one half of the geometry is shown in FIG. 3, and the other half may be obtained by a symmetric reflection of the first half. FIGS. 4A-4B illustrate the scattering cross-section as a function of frequency for the apparatus depicted in FIG. 3. Specifically, FIG. 4A shows the extinction cross-section from the optical theorem (extracted from the forward scattering amplitude). FIG. 4B shows the norm of the scattered field on the closed surface surrounding the apparatus.

Figure 5:
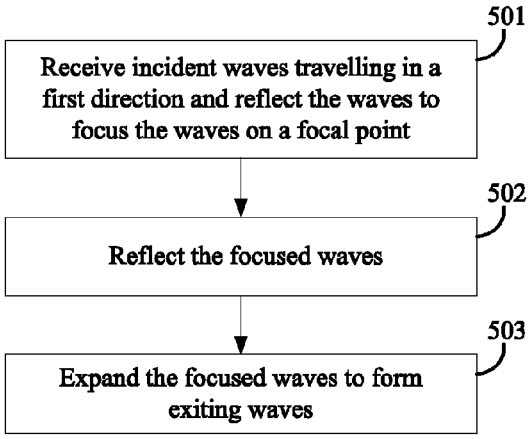
FIG. 5 is a flowchart illustrating a method of transmitting waves and/or reducing scattering according to one embodiment.

As described above, the apparatuses described herein may be used to transmit waves and at the same time reduce scattering. Various methods may be carried out by any of the apparatuses described herein. For example, one method may include exposing incident waves to any of the apparatuses described herein, such that the apparatus is used to transmit the waves as described above. Referring to FIG. 5, a method of reducing signal scattering is provided. In this embodiment, the method includes receiving incident waves travelling in a first direction at a first curved member and reflecting the waves to focus the waves on a focal point on a non-curved member (501). The method includes reflecting the focused waves from the non-curved member to a second curved member (502). The method further includes reflecting or expanding the focused waves from the second curved member to form exiting waves travelling in the first direction (503).

Figure 6:
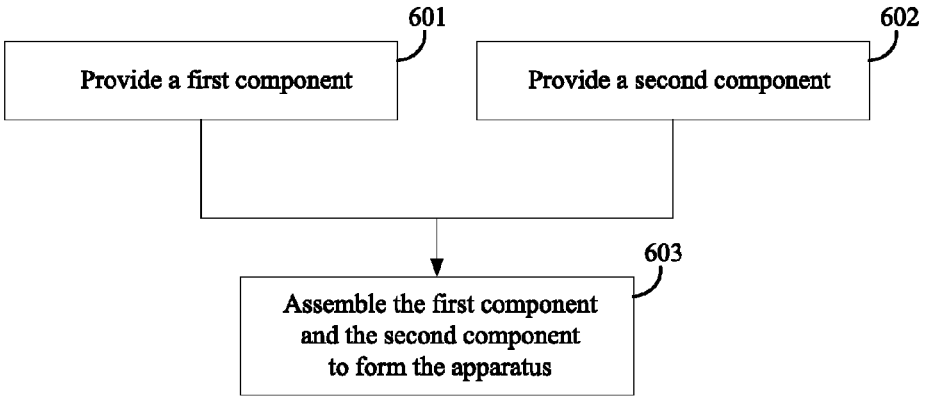
FIG. 6 is a flowchart illustrating a method of making an apparatuses for reducing scattering according to one embodiment.

The apparatuses described herein may be fabricated by any suitable methods. FIG. 6 illustrates a method for a fabrication in one embodiment. As shown in FIG. 6, a method of fabrication may include providing a first component (601) and providing a second component (602). The fabrication method may further include assembling the first component and the second component to form an apparatus (603). The different steps of the fabrication method may be carried out in any suitable order. As a part of the methods of making and/ur using the apparatus, computer modeling may be performed to verify or to be a part of the method of making/using the apparatus. The modeling may be carried out by a processor, such as that of a computer. Any suitable algorithm, including commercially available or custom written software stored in a non-transitory computer-readable medium may be employed to perform the modelling.

The method may additionally include forming the first component and/or second component by any suitable technique. In one alternative embodiment, the method of fabrication includes only the assembly of the first and second components. The first component and the second component may be any of those described herein.

The present disclosure contemplates methods, systems, and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed:

1. An apparatus for reducing electromagnetic scattering, comprising:

a first component including a plurality of curved segments, each including a first reflective material, and together forming an enclosed cavity; and a second component including a plurality of flat or cylindrically-curved segments, each including a second reflective material, wherein the second component is positioned external to the enclosed cavity;

wherein a first curved segment of the plurality of curved segments is configured to focus a plurality of incident signal waves on a focal point of a first flat or cylindrically-curved segment of the plurality of flat or cylindrically-curved segments; and wherein the first flat or cylindrically-curved segment is configured to redirect the focused waves from the focal point onto a second curved segment of the plurality of curved segments.

2. The apparatus of claim 1, wherein the plurality of curved segments is a plurality of parabolically-curved segments.

3. The apparatus of claim 1, wherein both the first and second components are rotationally invariant.

4. The apparatus of claim 1, wherein the first component includes four curved segments.

5. The apparatus of claim 1, wherein the first component is symmetric about two different planes.

6. The apparatus of claim 1, wherein the first and second components are configured to reduce scattering of a signal, wherein the signal includes electromagnetic radiation.

7. The apparatus of claim 1, wherein each of the plurality of curved segments is rotationally invariant about an axis of revolution, and wherein the flat or cylindrically-curved segments are cylindrically-curved segments concentric to the axis of revolution.

8. The apparatus of claim 1, wherein the apparatus is configured to receive an incident electromagnetic wave having a first impact parameter and provide an exiting electromagnetic wave having a second impact parameter, wherein the second impact parameter is greater than 90% of the first impact parameter and less than 110% of the first impact parameter.

9. An apparatus for reducing electromagnetic scattering, comprising:

a first component including a plurality of curved segments, each including a first reflective material, and together forming an enclosed cavity; and a second component including a plurality of flat or cylindrically-curved segments, each including a second reflective material, wherein the second component is positioned external to the enclosed cavity;

wherein a first curved segment of the plurality of curved segments is configured to focus a first portion of an incident plane wave on a focal point of a first flat or cylindrically-curved segment of the plurality of flat or cylindrically-curved segments;

wherein the first flat or cylindrically-curved segment is configured to redirect the focused waves from the focal point onto a second curved segment of the plurality of curved segments; and wherein the second curved segment is configured to expand the redirected and focused waves into a first portion of a plane wave exiting the apparatus.

10. The apparatus of claim 9, wherein a third curved segment of the plurality curved segments is configured to focus a second portion of the incident plane wave on a focal point of a second flat or cylindrically-curved segment of the plurality of flat or cylindrically-curved segments;

wherein the second flat or cylindrically-curved segment is configured redirect the focused waves from the focal point onto a fourth curved segment of the plurality of curved segments; and wherein the fourth curved segment is configured to expand the redirected and focused waves into a second portion of the plane wave exiting the apparatus.

* * * * *